US007868530B2

(12) United States Patent
Nagahara et al.

(10) Patent No.: US 7,868,530 B2
(45) Date of Patent: Jan. 11, 2011

(54) FILAMENT ELECTRODE AND FLUORESCENT LAMP

(75) Inventors: Toshiyuki Nagahara, Tokyo (JP); Koji Kikuchihara, Tokyo (JP); Masayuki Kanechika, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 447 days.

(21) Appl. No.: 11/965,374

(22) Filed: Dec. 27, 2007

(65) Prior Publication Data

US 2008/0157676 A1 Jul. 3, 2008

(30) Foreign Application Priority Data

Dec. 27, 2006 (JP) ..... 2006-353194

(51) Int. Cl.
*H01J 17/04* (2006.01)
*H01K 1/16* (2006.01)

(52) U.S. Cl. ..... 313/271; 313/356; 313/491; 313/341

(58) Field of Classification Search ..... 313/271, 313/279, 626, 356, 491, 341
See application file for complete search history.

(56) References Cited

U.S. PATENT DOCUMENTS 3,733,508 A * 5/1973 Rainone et al. ..... 313/579
4,370,589 A * 1/1983 DeCaro et al. ..... 313/315
5,057,735 A * 10/1991 Zalar et al. ..... 313/318.11
2007/0228913 A1 10/2007 Horikoshi et al.

FOREIGN PATENT DOCUMENTS

JP 03098254 A * 4/1991
JP 4245161 9/1992
JP 11297272 10/1999
JP 2005183267 A * 7/2005
JP 2005235749 9/2005

* cited by examiner

*Primary Examiner*—Karabi Guharay
(74) *Attorney, Agent, or Firm*—Kenealy Vaidya LLP

(57) ABSTRACT

The disclosed subject matter includes a filament electrode that can include a filament coil connected with a pair of lead wires with confidence. It is possible for a fluorescent lamp using the filament electrode to emit light with a wider range while located in a thin tube. The filament electrode can include a pair of connecting pipes, a pair of lead wires located parallel to each other, and a filament coil including two connecting parts. Each of the two connecting parts of the filament coil can attach to respective ends of the pair of lead wires via the pair of connecting pipes via pressure bonding so as not to contact the connecting parts of the filament coil with the ends of the pair of lead wires located in the pair of connecting pipes and so as to align the structures. Thus, the filament electrode can be used even in a thin glass or quartz tube and can provide an effective heat-shield operation.

30 Claims, 13 Drawing Sheets

FILAMENT ELECTRODE AND FLUORESCENT LAMP

This application claims the priority benefit under 35 U.S.C. §119 of Japanese Patent Application No. 2006-353194 filed on Dec. 27, 2006, which is hereby incorporated in its entirety by reference.

BACKGROUND

1. Field

The presently disclosed subject matter relates to a filament electrode and to a fluorescent lamp using the same. More particularly, the disclosed subject matter relates to a filament electrode that can connect a filament coil with a pair of lead wires with confidence and can be employed even if an inner diameter of the light source is thin. The disclosed subject matter also relates to a fluorescent lamp using the above connection structures that can decrease both end areas which do not emit light and can allow emission with a wider range.

2. Description of the Related Art

A conventional hot-cathode fluorescent lamp (HCFL), cold-cathode fluorescent lamp (CCFL) and the like can include respective electrodes for supplying a power supply at both ends of a light tube that can include a glass tube, silica tube, quartz tube, or other type of arc/luminescence tube. The conventional filament electrode is composed of, for example, a filament coil that is connected to a pair of lead wires. The respective filament coils can be encapsulated in the light tube that includes a filler gas. Respective pairs of lead wires can extend from the light tube to an area outside of the light tube along and can be sealed within the tube structure in an air proof state. Therefore, when supplying the respective filament coils with a power supply via the respective pairs of lead wires, the conventional HCFL, CCFL and the like emit by generating a discharge in the light tube.

FIGS. 8A&B show a conventional structure of the above-described filament electrode, wherein FIG. 8(A) shows a state before fixing the lead wires 2*a* and 2*b* to a filament coil 3 via pressure bonding and FIG. 8(B) shows a state after fixing via pressure bonding. The filament electrode 1 is composed of both the filament coil 3 and the pair of lead wires 2*a*, 2*b*, which are made from respectively different materials. Therefore, the filament coil 3 and the pair of lead wires 2*a*, 2*b* should be fixed to each other. Each of the pair of lead wires 2*a*, 2*b* can be composed of a conductive metallic material and located parallel or substantially parallel to each other. The filament coil 3 is composed of, for instance, a tungsten, a doped tungsten and the like and includes a coil body 3*a* formed in a spiral and two connecting parts 3*b*, 3*c* jutted out from both ends of the coil body 3*a* in a straight line.

The filament coil 3 is attached to the pair of lead wires 2*a*, 2*b* as shown in FIGS. 8(A) and (B). That is to say, the filament coil 3 includes: each of the two connecting parts 3*b*, 3*c* thereof contacting each end of the pair of lead wires 2*a*, 2*b* perpendicular to each other; each end of the pair of lead wires 2*a*, 2*b* bending in a direction as shown by the arrows in FIG. 8A; each end of the pair of lead wires 2*a*, 2*b* sandwiching each of the two connecting parts 3*b*, 3*c* therebetween; and each end of the pair of lead wires 2*a*, 2*b* crimping each of the two connecting parts 3*b*, 3*c* therebetween. Thus, the filament coil 3 is attached to the pair of lead wires 2*a*, 2*b* by fixing the two connecting parts 3*b*, 3*c* thereof to each end of the pair of lead wires 2*a*, 2*b* with pressure bonding.

However, according to the conventional filament electrode 1 shown in FIGS. 8A&B, because the filament coil 3 extends in a direction towards an inner diameter of the light tube when manufacturing a HCFL and the like, it is difficult for a thin inner diameter type HCFL light tube and the like to employ the filament electrode 1.

Therefore, an electrode structure as shown in FIG. 9 is also well-known. The filament electrode 4 includes a pair of lead wires 2*a*, 2*b* located parallel to each other and attached to a filament coil 5 that is longer in a direction extending with the length of the pair of lead wires 2*a*, 2*b* (downwards in FIG. 9) than its interval. The above filament coil 5 is composed of a coil body 5*a* forming double helical so as to wrap in both directions of left and right around a central axis thereof and two connecting parts 5*b*, 5*c* extending symmetrically from both ends of the coil body 5*a* in parallel to the central axis, respectively.

The filament coil 5 includes: each of the two connecting parts 5*b*, 5*c* thereof contacting each end of the pair of lead wires 2*a*, 2*b* in line with each other; each of the two connecting parts 5*b*, 5*c* thereof being welded with each end of the pair of lead wires 2*a*, 2*b* using a spot welding, a laser welding and the like. Therefore, each of the two connecting parts 5*b*, 5*c* are fixed to each end of the pair of lead wires 2*a*, 2*b*. Thus, the filament coil 5 is attached to the pair of lead wires 2*a*, 2*b* by welding each of the two connecting parts 5*b*, 5*c* thereof with each end of the pair of lead wires 2*a*, 2*b*. In the above described electrode structure, heat generated from the filament coil 5 during light-emission is directly transmitted to the pair of lead wires 2*a*, 2*b* and is radiated.

A revised example of the above described filament electrode 4 is disclosed in, for example, Patent Document No. 1 (Japanese Patent Application Laid Open No. JP2005-235749). FIG. 10 is the disclosed electrode structure in accordance with Patent Document No. 1. Each of two connecting parts 5*a*, 5*b* of a filament coil 5 is weld to each of a pair of heat-tabs 6*a*, 6*b* and each end of a pair of lead wires 2*a*, 2*b* is also welded to each of the pair of heat-tabs 6*a*, 6*b*. That is to say, the filament coil 5 is attached to the pair of lead wires 2*a*, 2*b* via the pair of heat-tabs 6*a*, 6*b* with a weld. Therefore, the above electrode structure of FIG. 10 is configured to radiate heat generated from the filament coil 5 to the pair of lead wires 2*a*, 2*b* via the pair of heat-tabs 6*a*, 6*b*.

FIG. 11 shows an electrode structure used for a bulb having double filaments. According to the electrode structure of the bulb 7 shown in FIG. 11, each of two filament coils 7*a* is welded to each of two lead wires 7*b* via each of two pipes 7*c*. Therefore, the electrode structure of the bulb 7 is configured to radiate heat generated from each of the two filament coils 7*a* to each of two lead wires 7*b* via each of the two pipes 7*c*.

An exemplary electrode structure of a fluorescent lamp is disclosed in Patent Document No. 2 (Japanese Patent Application Laid Open No. Hei04-245161). FIG. 12 is the disclosed electrode structure of the fluorescent lamp in accordance with Patent Document No. 2. The fluorescent lamp 8 includes: a mixture 8*c* disposed in a metallic pipe 8*b*, the mixture 8*c* including a mixture of metallic powder with an emitter powder; the mixture 8*c* is pressed during manufacture so as to form a hole around a central axis thereof; the metallic pipe 8*b* is sintered to an electrode 8*a* located therein along with the mixture 8*c*; the metallic pipe 8*b* can then be tightened up at a back end thereof towards a central axis of lead wire 8*e* that passes through a end portion of glass tube 8*d*; thereby fixing the electrode 8*a* to the lead wire 8*e*.

An exemplary electrode structure of a halogen bulb is disclosed in Patent Document No. 3 (Japanese Patent Application Laid Open No. Hei11-297272). FIG. 13 is the disclosed electrode structure of the halogen bulb 9. According to Patent Document No. 3, an electrode 9*a* is fixed to a lead wire 9*b* via a pipe 9*c* with a weld or a pressure bonding. In this case, because the pipe 9*c* is configured with a material of which the coefficient of thermal expansion (CTE) is bigger than that of tungsten which is the material of the electrode 9*a*, the pipe 9*c* expands because of heat generated from the electrode 9*a* during light-emission of the halogen bulb 9 and a gap is caused between the electrode 9*a* and the lead wire 9*b*. Thus, the heat generated from the electrode 9*a* cannot be directly transmitted to the lead wire 9*b* and an oxidation of the electrode 9*a* can be prevented.

The above-referenced Patent Documents are listed below and are incorporated herein by reference.

1. Patent Document No. 1: Japanese Patent Application Laid Open JP2005-235749

2. Patent Document No. 2: Japanese Patent Application Laid Open Hei04-245161

3. Patent Document No. 3: Japanese Patent Application Laid Open Hei11-297272

However, in the electrode structure of the filament electrode 4 shown in FIG. 9, the filament coil 5 is fixed to the pair of lead wires 2*a*, 2*b* by welding each of the two connecting parts 5*b*, 5*c* thereof with each end of the pair of lead wires 2*a*, 2*b*. Therefore, when welding each of the two connecting parts 5*b*, 5*c* with each end of the pair of lead wires 2*a*, 2*b*, a recrystallization of tungsten of the filament coil 5 can be caused, especially in the welding area. Therefore, the strength of fixing therebetween may become weak. As the result, the filament coil may become detached from the pair of lead wires 2*a*, 2*b* when a shock is applied thereto. A decrease of the fixing strength/intensity in a weld similar to the above-described weld can also be realized in the electrode structure of FIG. 10 and the bulb 7 of FIG. 11 described above.

In the above-described electrode structures of FIG. 8 to FIG. 10, heat generated from the filament coils 3, 5 is transmitted to the pair of lead wires 2*a*, 2*b* and is transmitted to a sealing portion between the pair of lead wires 2*a*, 2*b* and the glass tube. Thus, because a gap is caused in the sealing portion between the pair of lead wires 2*a*, 2*b* and the glass tube due to a difference between the CTE of glass of the sealing portion and that of a material of the pair of lead wires 2*a*, 2*b*, a filler gas in the glass tube may leak out. On the other hand, when a distance from each of the two connecting parts 3*b*, 3*c* and 5*b*, 5*c* of the filament coils 3, 5 to the sealing portion is extended by extending a length of the pair of lead wires 2*a*, 2*b*, the end areas of the tube that are not designed to emit light expands. Such an electrode structure is not desired for employment as a light source such as a back light unit and the like, because the both end areas in which light is not emitted is large.

In the fluorescent lamp 8 in accordance with Patent Document No. 2, the electrode 8*a* fixes the lead wire 8*e* by being sintered with the metallic pipe 8*b* and by fixing the back end of the metallic pipe 8*b* to the lead wire 8*e* with a pressure bonding. However, because the sinter bonding process for fixing the electrode 8*a* to the metallic pipe 8*b* is required, the process for manufacturing becomes complex.

In the electrode structure of the halogen bulb 9 in accordance with Patent Document No. 3, because the pipe 9*c* expands bigger than both the electrode 9*a* and the lead wire 9*b* during light-emission of the halogen bulb 9, a gap appears between the electrode 9*a* and the lead wire 9*b*. Thus, heat generated from the electrode 9*a* is not transmitted efficiently to the lead wire 9*b* because of the gap between the electrode 9*a* and the lead wire 9*b*, and the gap prevents the electrode 9*a* from oxidizing. However, because a transmission of the heat is shielded by the slight gap caused during light-emission of the halogen bulb 9 due to the difference of CTE between materials of both the electrode 9*a* and the lead wires 9*c* and a material of the pipe 9*c*, the heat-shield operation may be unstable or unpredictable, and electrical contact between the electrode 9*a* and the lead wire 9*b* may also become defective.

The disclosed subject matter has been devised to consider the above and other problems and characteristics. Thus, embodiments of the disclosed subject matter can include a filament electrode and associated stem that do not cause (or depreciates) some or all of the above-described various problems and can connect a filament coil with a pair of lead wires with confidence and strength. In addition, the filament electrode can be employed even if an inner diameter of a light source is very thin. The disclosed subject matter can also include a fluorescent lamp using the filament electrode that is configured to decrease that portion of the end areas that do not emit light, and to emit light with a wide range.

SUMMARY

The presently disclosed subject matter has been devised in view of the above and other problems and characteristics in the conventional art, and to make certain changes to the existing electrode structures. An aspect of the disclosed subject matter includes providing a filament electrode and associated stem that can connect a filament coil with a pair of lead wires with confidence and strength for supplying a power supply absolutely and which prevents leaks in a sealing portion. Furthermore, the filament electrode can be used even in a thin inner diameter tube.

Another aspect of the disclosed subject matter includes providing a fluorescent lamp using the above described filament electrode that can decrease both end areas which are not configured for emission of light and which can emit light with a wider range. Thus, because the fluorescent lamp can be formed to be thin and can extend a light-emission area thereof, it can be employed as a light source for a back light unit, etc.

According to an aspect of the disclosed subject matter, a filament electrode can include: a pair of connecting pipes formed in a tubular manner; a pair of lead wires located parallel with respect to each other, each with an end thereof attached to a respective end of the pair of connecting pipes in a telescoped state via pressure bonding, and each with an opposite respective end thereof exposed in order to supply a power supply; and a filament coil including two connecting parts, each of the two connecting parts attached to each of the opposite respective ends of the pair of connecting pipes in a telescoped state via pressure bonding so as not to contact the ends of the pair of lead wires in each of the pair of connecting pipes.

In the above described exemplary filament electrode, the filament electrode can also include the pair of connecting pipes that are composed of a conductive material having a coefficient of thermal conductivity that is smaller than that of the pair of lead wires. The pair of connecting pipes can also include a squeezing part between each end thereof and each respective other end thereof. The squeezing part can be formed in a tapered shape so as to shrink from each first end thereof towards each respective other end thereof. In addition, the pair of connecting pipes can also function as a getter, for example, by being made of certain reactive materials to ensure and maintain proper atmospheric chemical make-up and pressure qualities within the tube.

In the above described exemplary filament electrode, the filament electrode can further include a glass bead formed in a circular manner, wherein the glass bead is provided around a proximal portion of each exposed end of the pair of lead wires and can achieve an air proof state between the glass bead and the pair of lead wires. The above filament electrode including the glass bead can be a convenient structure for manufacturing a fluorescent lamp as described later.

According to the above described exemplary filament electrode, because each of the two connecting parts of the filament coil can connect each corresponding end of the pair of lead wires via the pair of connecting pipes, a power supply can be provided to the filament coil with great consistency. In that case, because each of the two connecting parts of the filament coil can align each of the pair of lead wires via each of the pair of connecting pipes in line with a direction parallel or co-axial with a longitudinal axis or length of the tube, the filament electrode can be installed in the tube with confidence even if an inner diameter of tube is thin.

In addition, because each of the two connecting parts of the filament coil can firmly attach to each of the pair of connecting pipes via pressure bonding, the fixing intensity does not weaken due to recrystallization of tungsten of the filament coil. Thus, the filament coil is not prone to detachment from the pair of lead wires and can be confidently supplied with a power supply.

Furthermore, when the pair of connecting pipes is composed of a material for which the coefficient of thermal conductivity is smaller than that of the pair of lead wires, because heat generated from the filament coil is then not transmitted efficiently to the pair of lead wires, a gap that may otherwise be caused between the glass bead and the pair of lead wire can be prevented and therefore a filler gas in the glass tube can be prevented from leaking out.

Another aspect of the disclosed subject matter includes a fluorescent lamp using the immediately above-described filament electrode that can include: a glass, quartz or other tube formed in a tubular fashion, an inner surface thereof forming a phosphor layer, and both ends thereof providing respective filament electrodes so as to be located opposite to each other and so as to be fixed between both ends of the tube and the respective glass beads provided at the respective pairs of lead wires in their respective air proof state; and a filler gas can be located in the tube.

According to the above described exemplary fluorescent lamp, because the pair of lead wires is not heated to an extreme degree as describe above, the one end of the pair of lead wire can be located near the end of the tube. Thus, the fluorescent lamp can be configured to decrease the portions of the end areas at which light is not emitted and can be configured to emit a light with a wide area.

BRIEF DESCRIPTION OF THE DRAWINGS

These and other characteristics and features of the disclosed subject matter will become clear from the following description with reference to the accompanying drawings, wherein:

FIGS. 8(A)-(B) are schematic perspective views showing a conventional electrode structure, wherein FIG. 8(A) shows a state before pressure bonding and FIG. 8(B) shows a state after pressure bonding;

DETAILED DESCRIPTION OF EXEMPLARY EMBODIMENTS

Figure 1:
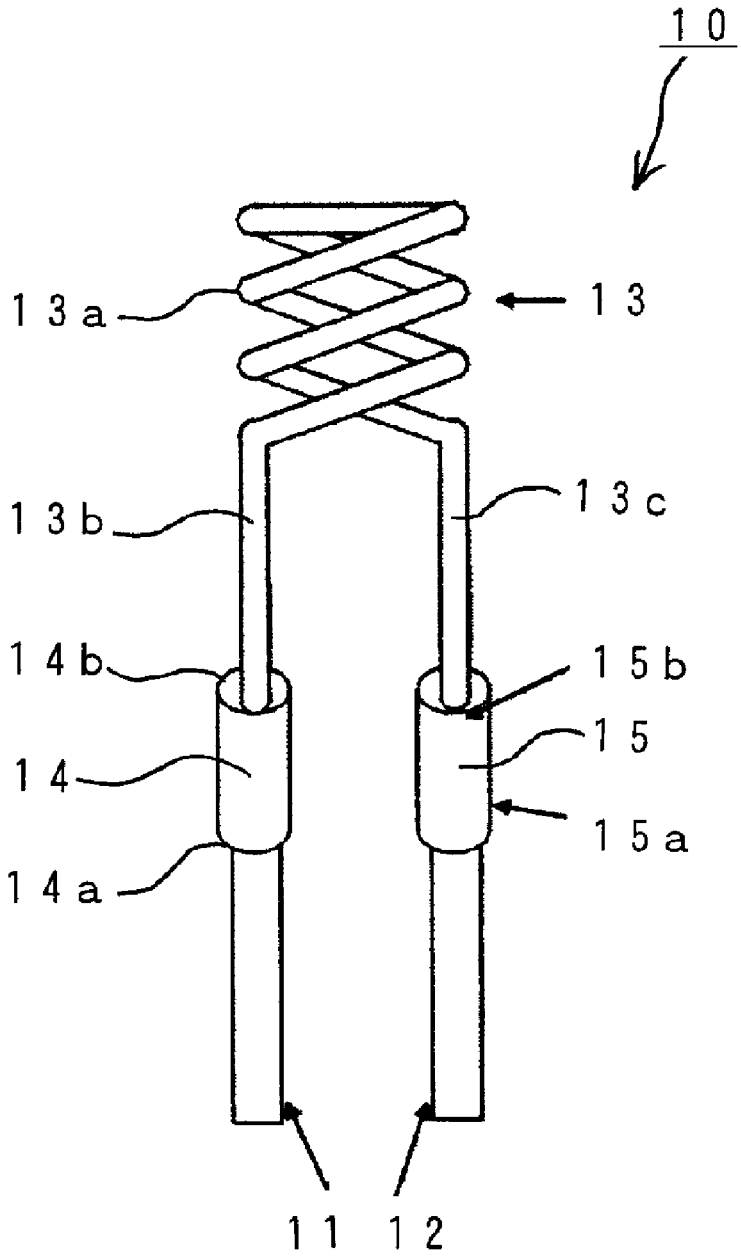
FIG. 1 is a schematic perspective view showing an embodiment of an electrode structure for a filament electrode made in accordance with principles of the disclosed subject matter.

Exemplary embodiments of the disclosed subject matter will now be described in detail with reference to FIG. 1 to FIG. 7. FIG. 1 is a schematic perspective view showing an example of an electrode structure for a filament electrode made in accordance with principles of the disclosed subject matter. The filament electrode 10 can include a pair of lead wires 11, 12, a filament coil 13 and a pair of connecting pipes 14, 15.

The pair of lead wires 11, 12 can be composed of a conductive metallic material and can be located parallel with respect to each other. The filament coil 13 can be composed of, for instance, a tungsten (W), a rhenium tungsten (W—Re), a doped tungsten and the like.

The above filament coil 13 can include a coil body 13*a* formed in a double helical and two connecting parts 13*b*, 13*c* extending from both ends of the coil body 13*a* in a direction parallel with a central axis thereof (downwards in FIG. 1). The coil body 13*a* can be formed, for example, as a double helical so as to wrap in both left and right directions around the central axis thereof as shown in FIG. 1. However, a shape of coil body 13*a* should not be limited to the shape of FIG. 1. The shape can be formed in a voluntary fashion, for example, C-6 or C-8 like a vehicular bulb. In addition, the filament coil 13 can be coated with an emissive material, for instance, an oxide composed of a barium (Ba), a strontium (Sr), a calcium (Ca) and the like on a surface thereof.

The above-described pair of connecting pipes 14, 15 can be composed of a conductive metallic material and can be formed in a hollow tubular configuration. The pair of connecting pipes 14, 15 can be composed of a metallic material for which the coefficient of thermal conductivity is smaller than that of the pair of lead wires 11, 12, such as a nickel and an iron metal, for which the coefficient of thermal conductivity is less than 115 W/m·K.

The pair of connecting pipes 14, 15 can be configured as and function as a getter. When the pair of connecting pipes 14, 15 is composed of a material having a getter function or is formed with a material having a getter function coated on an inner surface or an outer surface of the pair of connecting pipes 14, 15, the getter function can be activated in the pair of connecting pipes 14, 15. The getter material can be coated via vapor deposition or other known coating or fixation method.

When the pair of connecting pipes 14, 15 includes a getter function, the pair of connecting pipes 14, 15 can be composed of, for example, a material of titanium series and a material of zirconium series. When a surface of the pair of connecting pipes 14, 15 is formed of a comparatively low conductive material having a getter function, the material can form an outer surface of the pair of pipes 14, 15.

Figure 2:
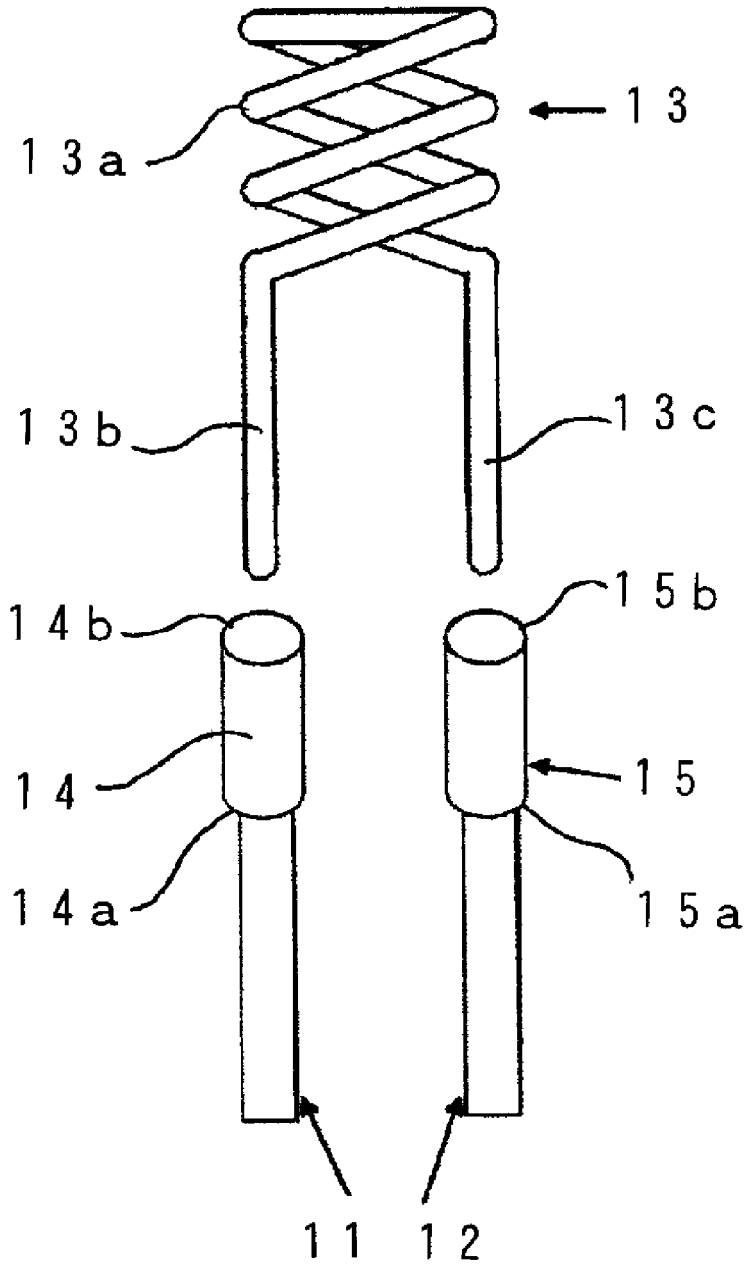
FIG. 2 is a schematic perspective view showing a halfway state in an exemplary manufacturing process for the filament electrode shown in FIG. 1.

A description of the specific electrode structure for the filament electrode 10 will now be given. Each first end 14*a*, 15*a* of the pair of connecting pipes 14, 15 can be telescoped onto an end of the pair of lead wires 11, 12 located therein as shown in FIG. 2. Each first end 14*a*, 15*a* of the pair of connecting pipes 14, 15 can be constricted over each end of the pair of lead wires 11, 12 from both sideward directions as show in FIG. 3. Thus, the pair of lead wires 11, 12 can be attached to the pair of connecting pipes 14, 15 so that each the ends of the wires 11, 12 are sandwiched in each distorted first end 14*a*, 15*a* of the pair of connecting pipes 14,15 and are thus fixed via pressure bonding. However, the pair of lead wires 11, 12 can also be attached to the pair of connecting pipes 14, 15 by fixing each end of the wires 11, 12 to each respective first end 14*a*, 15*a* of the pair of connecting pipes 14, 15 with a weld. Each of the other ends of the pair of lead wires 11, 12 can be exposed in order to provide a power supply to the lamp via a socket and the like.

Figure 3:
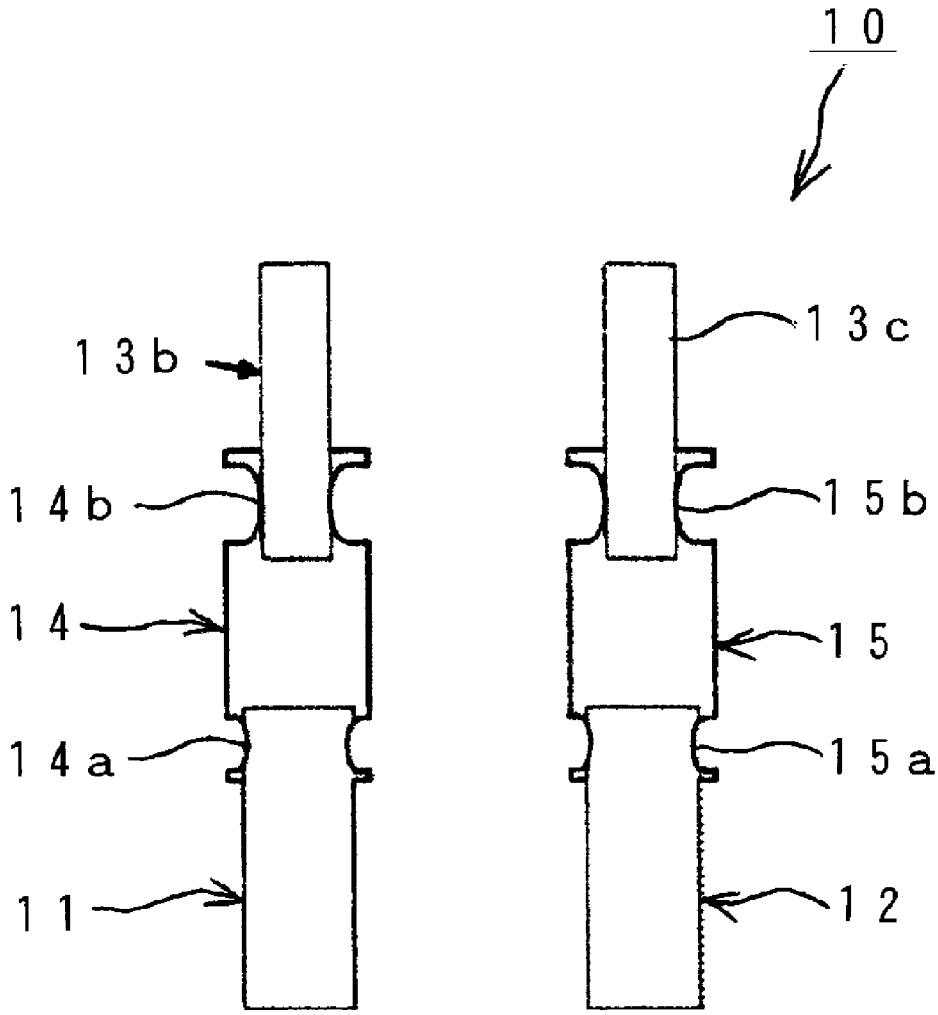
FIG. 3 is an enlarged cross-section view showing a pair of connecting pipes of the filament electrode shown in FIG. 1.

Each opposite end 14*b*, 15*b* of the pair of connecting pipes 14, 15 can be telescoped onto two connecting parts 13*b*, 13*c* of the filament coil 13 as shown in FIG. 3. Each opposite end 14*b*, 15*b* of the pair of connecting pipes 14, 15 can be constricted over each end of the two connecting parts 13*b*, 13*c* of the filament coil 13 from sideward directions. Thus, the filament coil 13 can be attached to the pair of connecting pipes 14, 15 so that each end of two connecting parts 13*b*, 13*c* is sandwiched in a respective distorted opposite end 14*b*, 15*b* of the pair of connecting pipes 14, 15 and is fixed via pressure bonding.

In the above-described two attachment configurations for the pair of connecting pipes 14, 15, pair of lead wires 11, 12, and two connecting parts 13*b*, 13*c* of the filament coil 13, either of the ends can be the first to be attached and/or both of the ends can be attached at the same time. However, when each end of the pair of lead wires 11, 12 is attached to each first end 14*a*, 15*a* of the pair of connecting pipes 14, 15 with a weld, for example, after fixing with the weld, the filament coil 13 can be attached to the pair of connecting pipes 14, 15 via pressure bonding. The reason why the weld is carried out first because it can absolutely eliminate an effect of transmitting heat to the filament coil 13 during the weld process.

The filament electrode 10 in accordance with an exemplary embodiment of the disclosed subject matter can be constituted as described above. A manufacturing process for the filament electrode 10 can include: providing the pair of connecting pipes 14, 15 with each first end 14*a*, 15*a* telescoped over respective ends of the pair of lead wires 11, 12; attaching each end of the pair of lead wires 11, 12 to respective first ends 14*a*, 15*a* of the pair of connecting pipes 14, 15 with a weld or via pressure bonding; attaching each of the opposite ends 14*b*, 15*b* of the pair of connecting pipes 14, 15 by telescoping them over each end of two connecting parts 13*b*, 13*c* of the filament coil 13; and attaching each end of the two connecting parts 13*b*, 13*c* of the filament coil 13 to respective opposite ends 14*b*, 15*b* of the pair of connecting pipes 14, 15 via pressure bonding.

In this case, each end of the two connecting parts 13*b*, 13*c* of the filament coil 13 can be configured to telescope into respective opposite ends 14*b*, 15*b* of the pair of connecting pipes 14, 15 while also not contacting respective ends of the pair of lead wires 11, 12 which telescope into respective first ends 14*a*, 15*a* of the pair of connecting pipes 14, 15. This is accomplished by allowing each end of the two connecting parts 13*b*, 13*c* of the filament coil 13 to telescope within the opposite ends 14*b*, 15*b* of the connecting pipes 14, 15 so as to maintain a predetermined interval between each end of the two connecting parts 13*b*, 13*c* and each end of the pair of lead wires 11, 12 in each of the pair of connecting pipes 14, 15. Thus, the filament coil 13 and the pair of lead wires 11, 12 can be fixed with respect to each other at a predetermined interval via the pair of connecting pipes 14, 15 in the filament electrode 10.

In the above-described structure, because the filament coil 13 can be attached in each of the opposite ends 14*b*, 15*b* of the pair of connecting pipes 14, 15 via pressure bonding, recrystallization of a material such as tungsten and the like composing the filament coil 13 cannot create a weld-like structure. Thus, because the fixing intensity in the filament electrode 10 does not become weak, the filament coil 13 should not become detached from the ends of the pair of lead wires 11, 12 and, therefore, reliability of the filament electrode 10 can increase.

Furthermore, because each end of the two connecting parts 13*b*, 13*c* of the filament coil 13 can be attached to respective ends of the pair of lead wires 11, 12 via the pair of connecting pipes 14, 15, the filament electrode 10 can extend in a direction parallel with a longitudinal axis of the tube. Thus, even if a diameter of the tube is thin, the filament electrode 10 can be easily installed in the thin tube.

Figure 4:
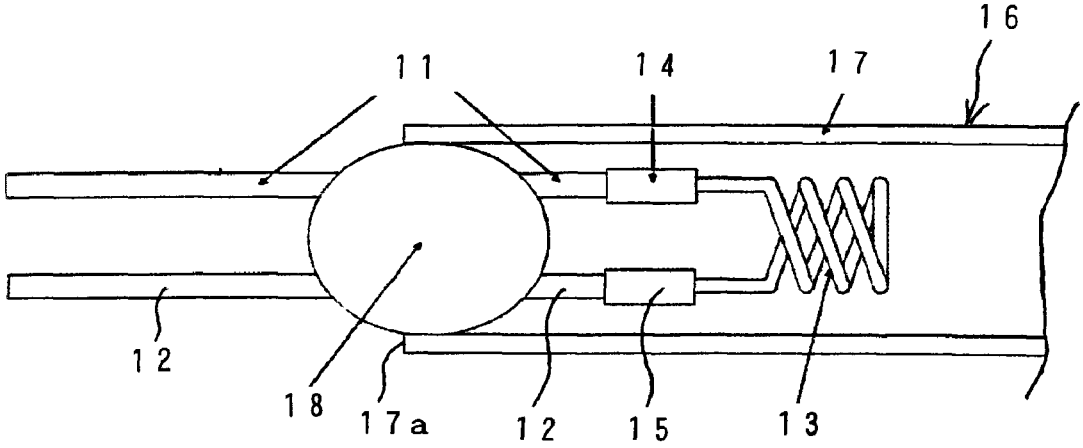
FIG. 4 is a partial cross-section view depicting an installed state for the filament electrode of FIG. 1 in a fluorescent lamp.

FIG. 4 is a partial cross-section view depicting a state in which the filament electrode 10 is installed in one end of a fluorescent lamp, and in which the other end of the lamp can be symmetrical and include the same filament electrode 10. Before manufacturing a fluorescent lamp and the like, the filament electrode 10 can form a stem wherein a bead 18 made of glass, quartz, or the like, is provided around a proximal portion of a pair of lead wires 11, 12 in a substantially or totally air proof state between the bead 18 and the pair of lead wire 11, 12. The above described filament electrode including the bead 18 can be a convenient structure for manufacturing a fluorescent lamp. The bead 18 can be provided at a bead location on the pair of lead wires 11, 12 proximal with respect to the connection location at which the pair of lead wires 11, 12 are attached to the pair of connecting pipes 14, 15. The connection location can be located between the bead location and the filament coil 13.

The fluorescent lamp 16 can include: a tube 17 configured in a tubular shape from glass, quartz, or the like, an inner surface of the tube 17 can include a phosphor layer, and both ends 17*a* of the tube 17 can include respective filament electrodes 10 so as to be located opposite to each other and so as to be fixed between both ends 17*a* of the glass tube 17 and the respective glass beads 18 provided on the respective pairs of lead wires 11, 12 in their respective air proof states. A filler gas can be located in the tube 17.

When a power supply is provided between respective ends of the pairs of lead wires 11, 12, the respective filament coils 13 can be heated and can operate as respective heaters. Thus, because the fluorescent lamp can generate a discharge in the tube 17 with a discharge voltage between each of the filament electrodes 10 attached to both ends 17*a* of the tube 17, the fluorescent lamp 16 can emit light.

In this case, when the pair of connecting pipes 14, 15 is composed of a material having a smaller coefficient of thermal conductivity than that of the pair of lead wires 11, 12, it is difficult to transmit heat generated from the filament coil 13 during light-emission of the fluorescent lamp 16 to the pair of lead wires 11, 12 via the pair of connecting pipes 14, 15. Thus, in the sealing portions of both ends 17*a* of the tube 17 and the respective beads 18 (and between the respective pairs of lead wires 11, 12 and the respective glass beads 18) the filler gas in the tube 17 can be prevented from leaking out due to a gap caused by differences of CTE between the ends 17*a* of the tube 17 and the respective beads 18, and/or based on differences of CTE between the respective pairs of lead wires 11, 12 and the respective beads 18.

In addition, because the pair of lead wires 11, 12 are not extremely heated, each end of the respective pairs of lead wires 11, 12 can be located near respective ends 17*a* of the tube 17. Thus, when manufacturing a fluorescent lamp using other conventional types of filament electrodes in a tube as long as the tube 17, the above-described fluorescent lamp using the filament electrode 10 can emit brighter light than the other conventional fluorescent lamp.

Furthermore, because the filament coil 13 can be coated with an emissive material, the emissive material can emit an electron in the tube 17 by heating the filament coil 13 and the discharge in the tube 17 can be accelerated. In addition, because the pair of connecting pipes 14, can be configured to function as a getter, the pair of connecting pipes 14, 15 can absorb gas molecules such as impure substances and the like located in the tube 17. Therefore, the fluorescent lamp 16 can improve its discharging state, its sputter and the like in the tube 17.

Figure 5A:
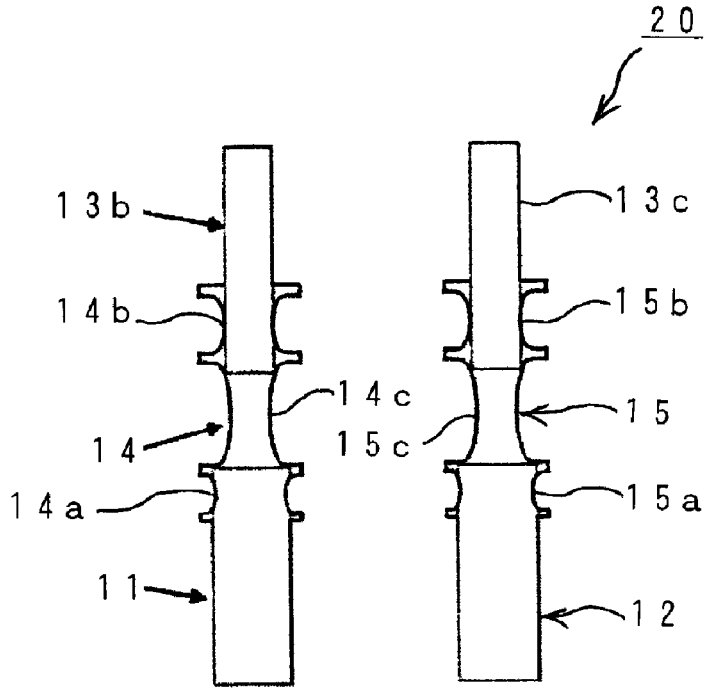
FIGS. 5(A) and (B) are enlarged cross-section views showing a second exemplary embodiment of a pair of connecting pipes for a filament electrode made in accordance with principles of the disclosed subject matter.
Figure 5B:
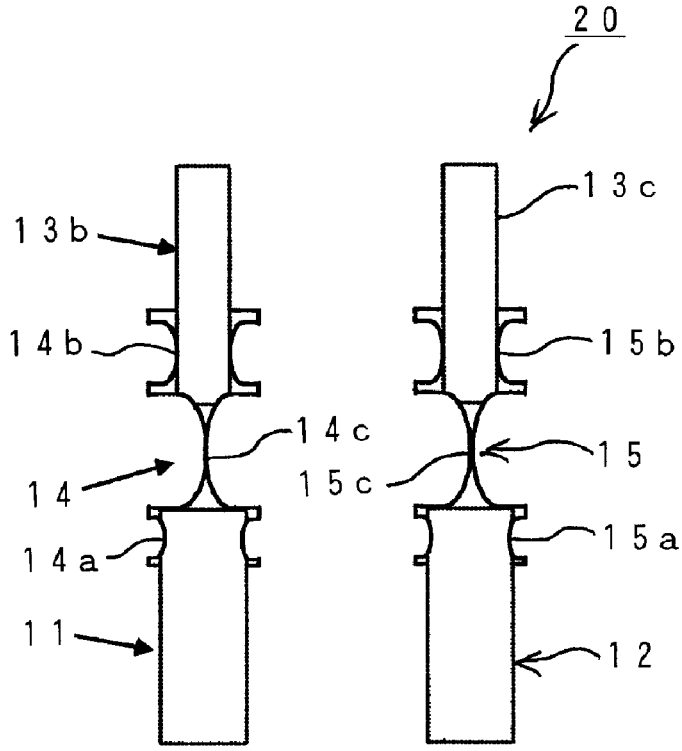

A second exemplary embodiment of the disclosed subject matter will now be given with reference to FIGS. 5(A)-(B). Relevant parts of the filament electrode 20 of the second exemplary embodiment are shown in FIGS. 5(A)-(B), wherein the same or similar elements shown in FIGS. 1 and 4 are referenced by same reference numerals. A difference between the filament electrode 20 and the filament electrode 10 can include a pair of squeezing parts 14*c*, 15*c* between each first end 14*a*, 15*a* and each opposite end 14*b*, 15*b* of the pair of connecting pipes 14, 15. The pair of squeezing parts 14*c*, 15*c* can be formed thinner than both the first ends 14*a*, 15*a* and the opposite ends 14*b*, 15*b* and can also span the first and opposite ends in an arch formed as shown in FIG. 5(B).

According to the second exemplary embodiment, when each of the two connecting parts 13*b*, 13*c* of the filament coil 13 telescopes into each of the opposite ends 14*b*, 15*b* of the pair of connecting parts 14, 15, the pair of squeezing parts 14*c*, 15*c* can operate as stoppers of the two connecting parts 13*b*, 13*c* of the filament coil 13. In addition, when each end of the pair of lead wires 11, 12 telescopes into each first end 14*a*, 15*a* of the pair of connecting parts 14, 15, the pair of squeezing parts 14*c*, 15*c* can operate as stoppers of the lead wires 11. 12 with respect to the pair of connecting parts 14, 15. Thus, contact between each of the two connecting parts 13*b*, 13*c* of the filament coil 13 with each end of the pair of lead wires 11, 12 located in the pair of connecting parts 14, 15 can be avoided without exception.

In addition, because it can become harder for heat generated from the filament coil 13 during light-emission of the fluorescent lamp 16 to be transmitted via connecting pipes 14, 15 to the pair of lead wires 11, 12, each of the ends of the pair of lead wires 11, 12 can be located nearer respective ends 17*a* of the tube 17. Thus, those end areas in which light is not emitted in the tube 17 can be made smaller and the fluorescent lamp can thus emit light with a wider range.

Figure 6:
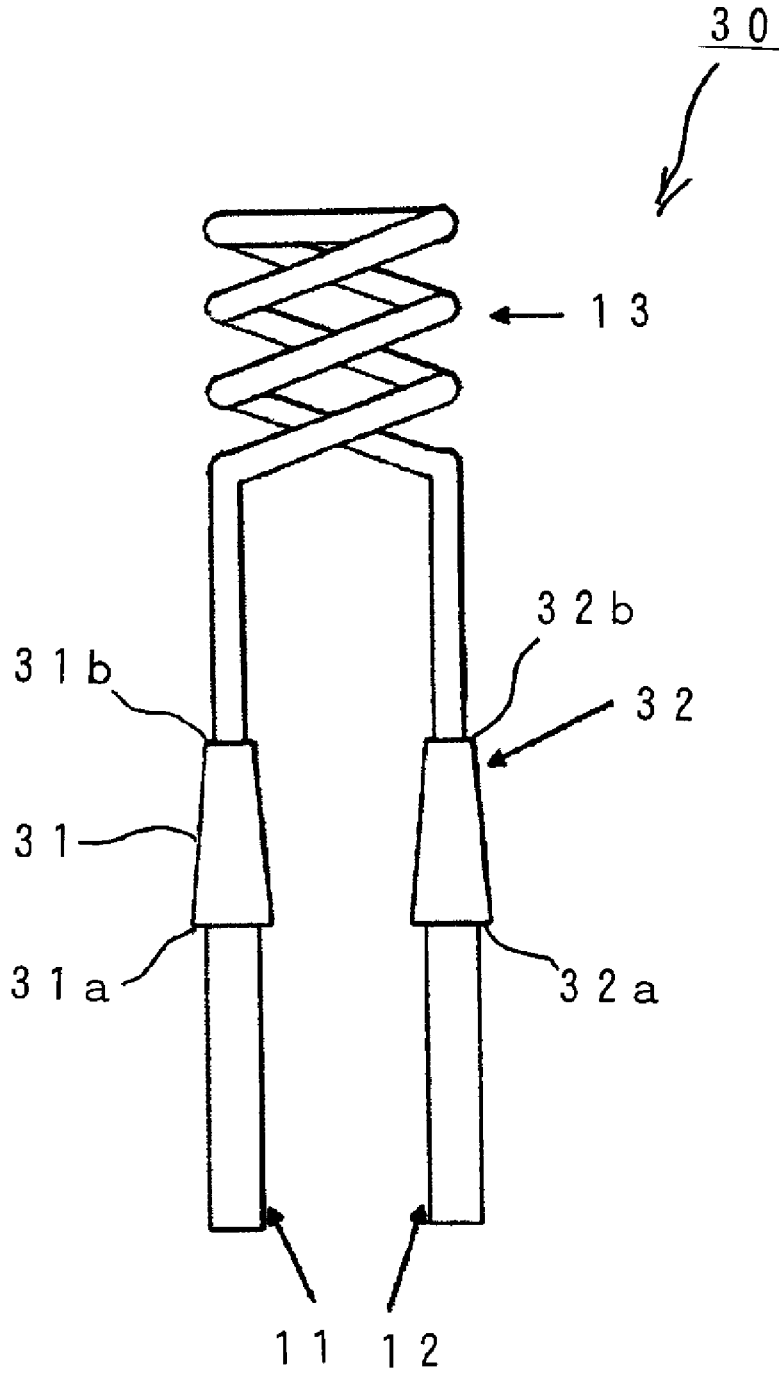
FIG. 6 is a schematic perspective view showing a third exemplary embodiment of an electrode structure for a filament electrode made in accordance with principles of the disclosed subject matter.

A third exemplary embodiment of the disclosed subject matter will now be described with reference to FIG. 6. FIG. 6 shows a filament electrode 30 that can be configured similar to the filament electrode 10 shown in FIG. 1. Thus, the same or similar elements in FIG. 6 are referenced using the same reference numerals as those in FIG. 1. A difference between the filament electrode 30 and the filament electrode 10 can include providing a pair of connecting pipes 31, 32 in place of the pair of connecting pipes 14, 15 which are shown as formed in a generally cylindrical tubular shape. The pair of connecting pipes 31, 32 can formed such that they are tubular while also shrinking in diameter along their longitudinal axis in a tapered manner and shape from each first end 31*a*, 32*a* towards each opposite end 31*b*, 32*b* of the pair of connecting pipes 31, 32.

Figure 7A:
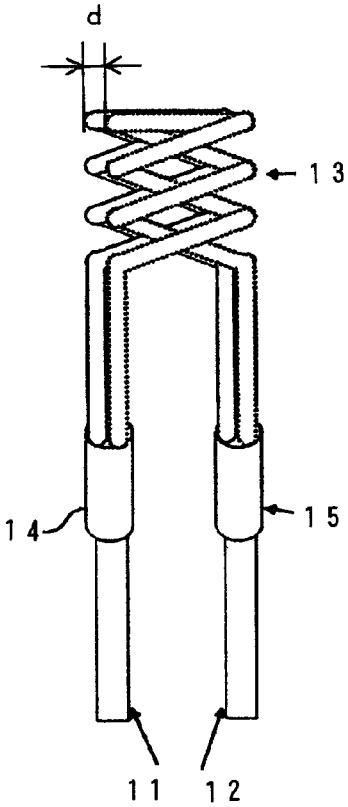
FIGS. 7(A)-(C) are a schematic perspective view for a description of misalignment in a sideward direction of two connecting parts of a filament coil to a pair of connecting pipes in the filament electrode shown in FIG. 1; a schematic perspective view depicting shapes of filament coils in a C-6 type bulb for a vehicular lamp; and a schematic perspective view depicting the shape of filament coils in a C-8 type bulb, respectively.
Figure 7B:
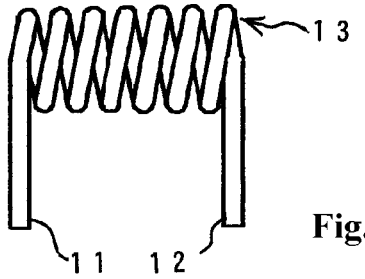
Figure 7C:
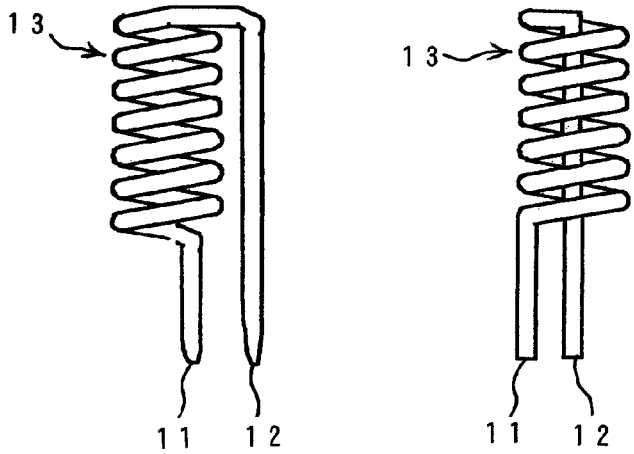
Figure 8A:
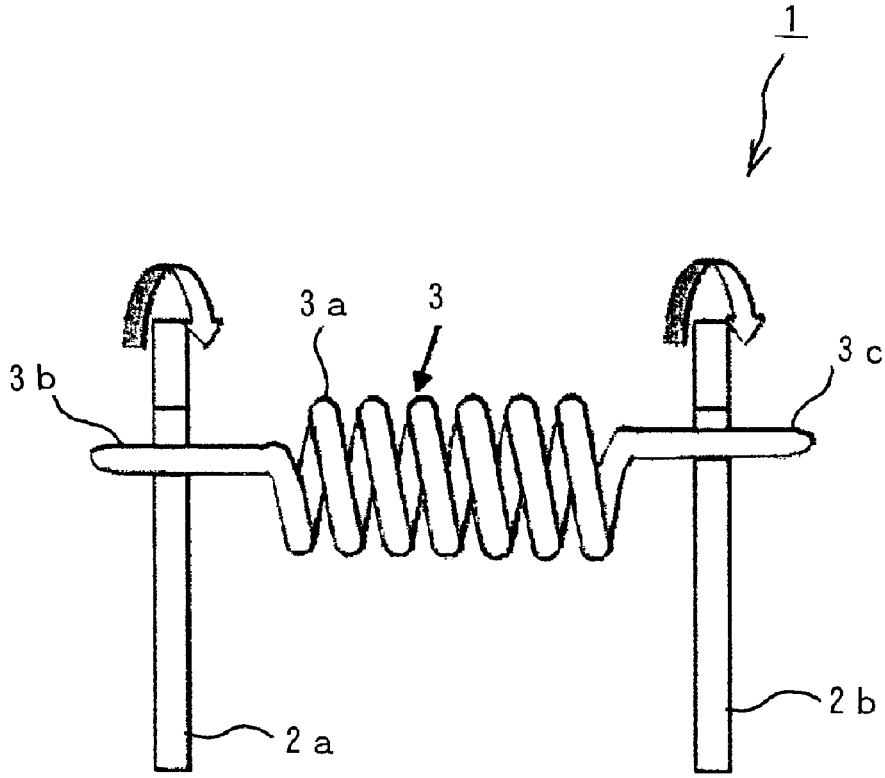
Fig.8(A) Conventional Art
Figure 8B:
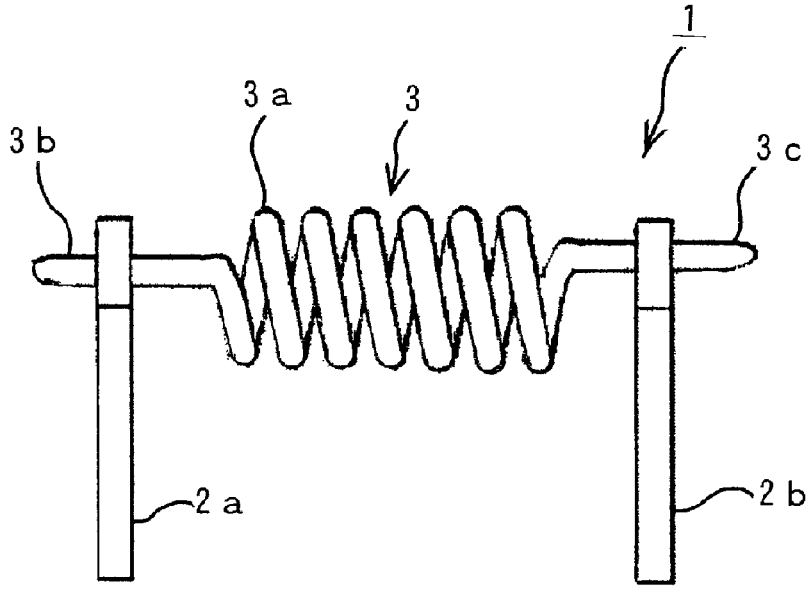
Fig.8(B) Conventional Art
Figure 9:
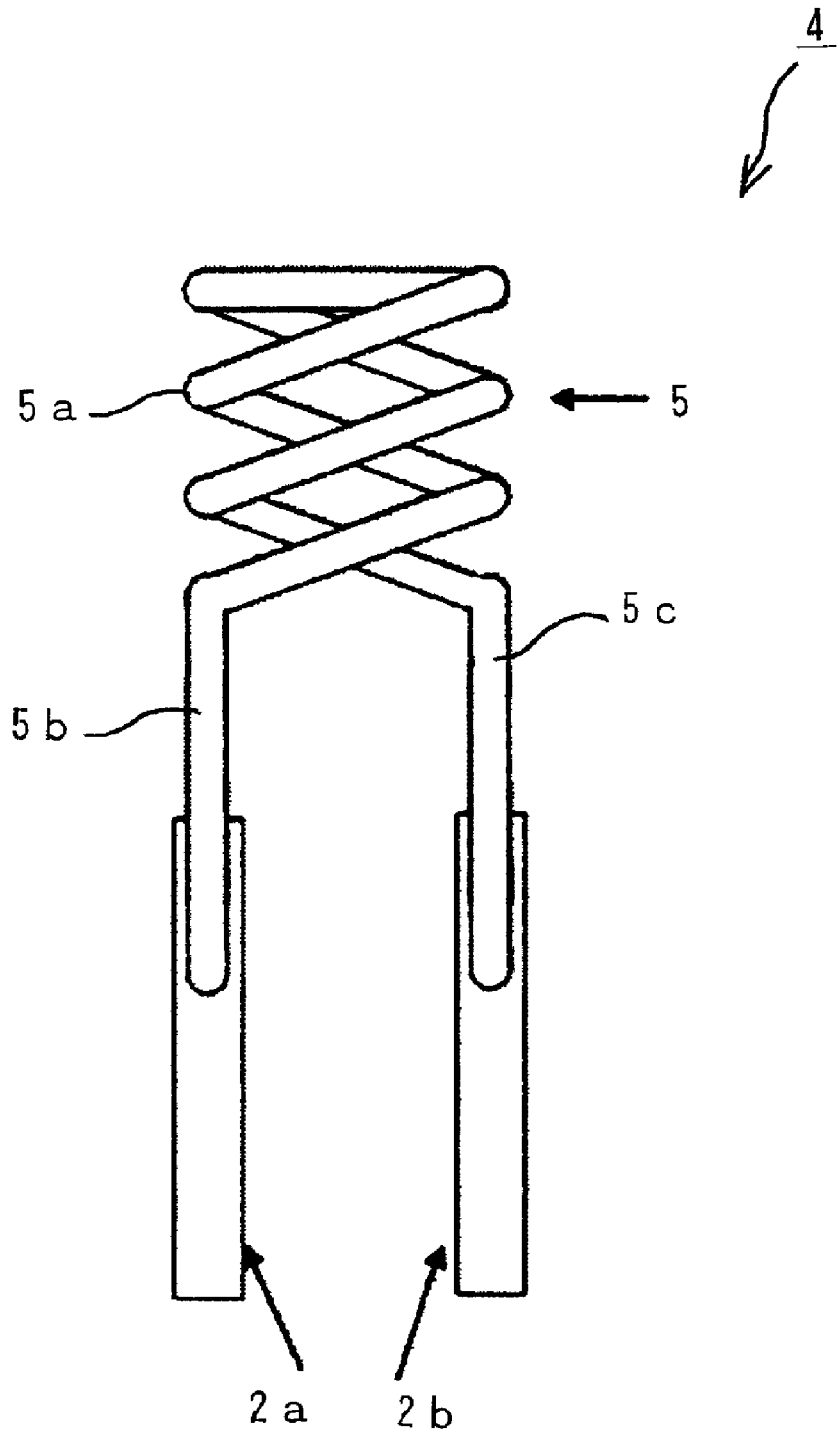
Fig.9 Conventional Art
FIG. 9 is a schematic perspective view depicting a second example of a conventional electrode structure.
Figure 10:
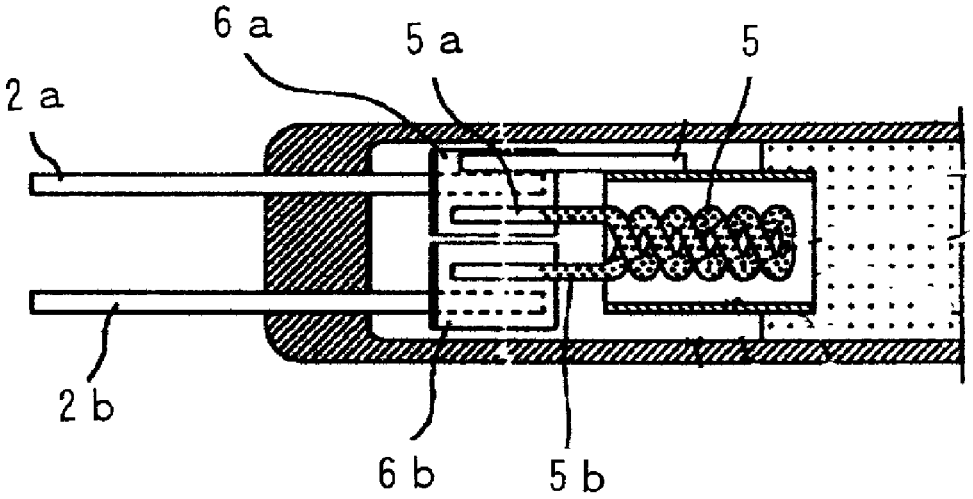
Fig.10 Conventional Art
FIG. 10 is a schematic cross-section view depicting a third example of a conventional electrode structure.
Figure 11:
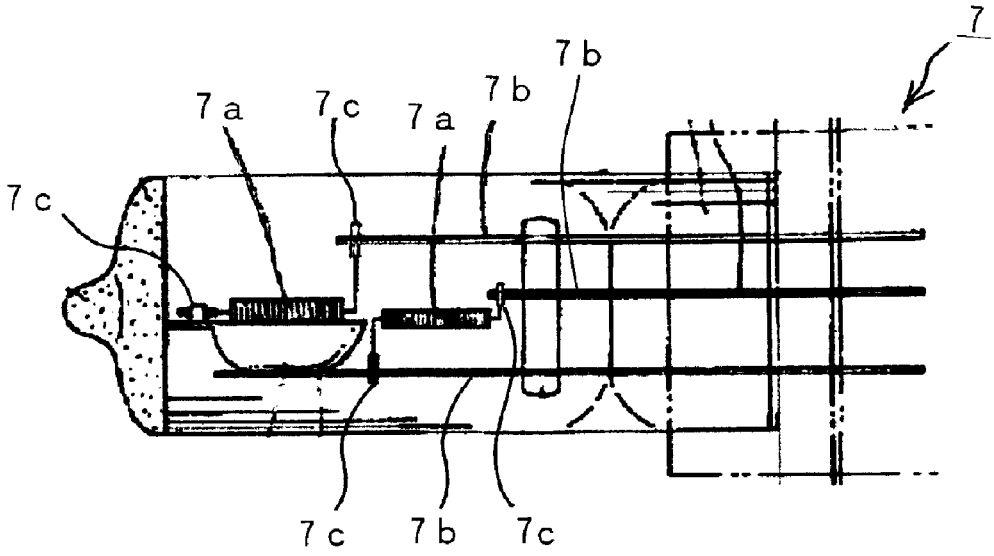
Fig.11 Conventional Art
FIG. 11 is a schematic cross-section view depicting a fourth example of a conventional electrode structure.
Figure 12:
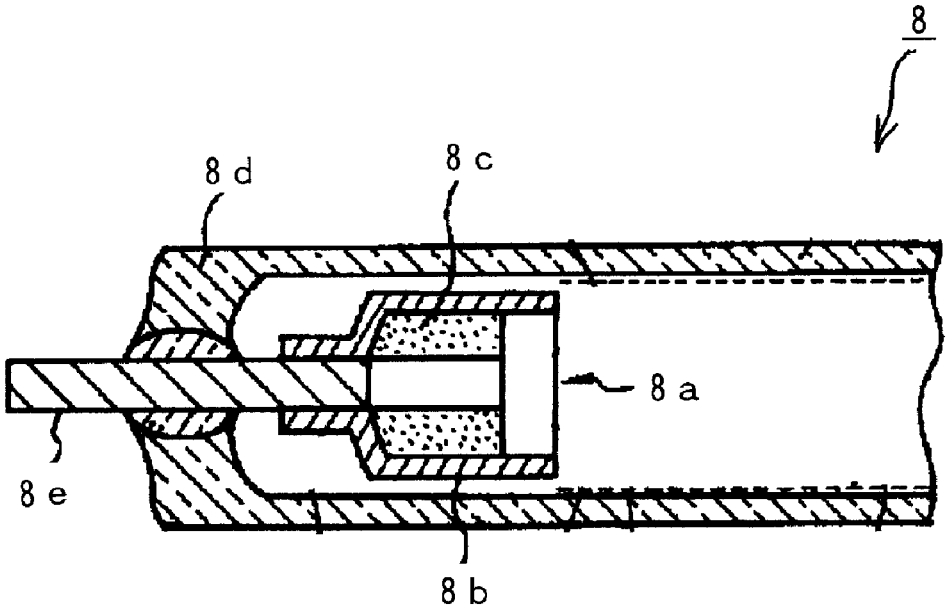
Fig.12 Conventional Art
FIG. 12 is a schematic cross-section view depicting a fifth example of a conventional electrode structure.
Figure 13:
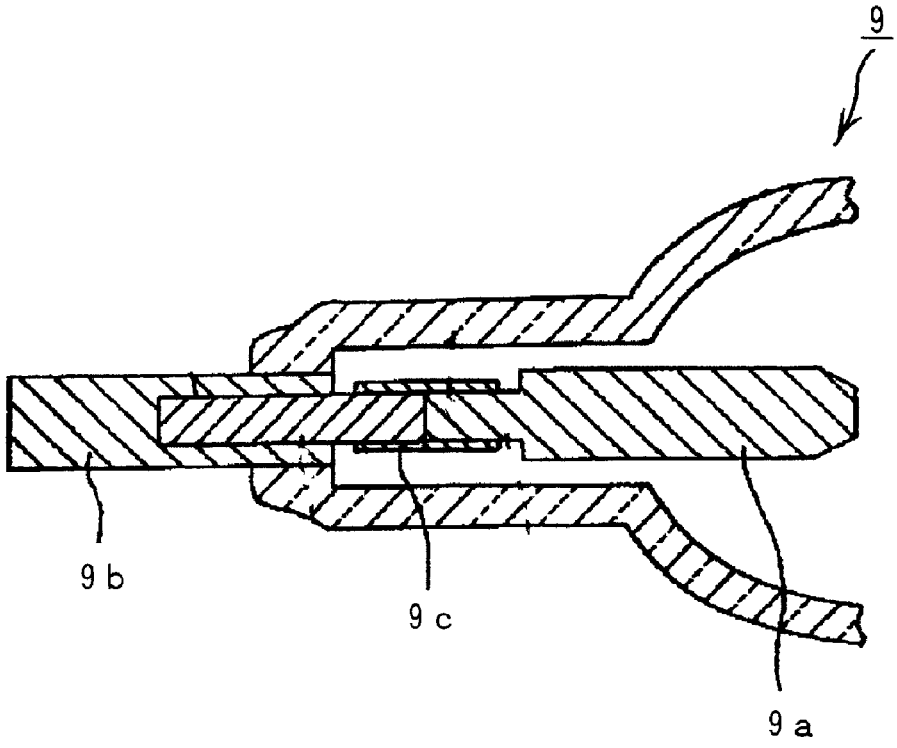
Fig.13 Conventional Art
FIG. 13 is a schematic cross-section view depicting a sixth example of a conventional electrode structure.

According to the third exemplary embodiment, when the diameter of each of the apertures of the opposite ends 31*b*, 32*b* corresponds with a respective diameter of the two connecting parts 13*b*, 13*c* of the filament coil 13, the filament coil 13 can be exactly attached to the pair of lead wires 11, 12 so that each of the two connecting parts 13*b*, 13*c* thereof aligns with each of the pair of connecting pipes 31, 32. Therefore, a problem in that each of the two connecting parts 13*b*, 13*c* of the filament coil 13 is misaligned with each of the pair of connecting pipes 14, 15 by an amount "d" as shown in FIG. 7(A) cannot be present in the above-described exemplary embodiment. Thus, the filament coil 13 can be attached to the pair of lead wires 11, 12 with a high positioning accuracy.

Thus, the disclosed subject matter can provide a filament electrode that can connect a filament coil with a pair of lead wires with confidence and strength and with minimal or no leakage at the sealing portions, which can be the result and benefits of an effective heat-shield operation. The filament electrode can also be employed in a thin inner diameter tube. Furthermore, the disclosed subject matter can provide a fluorescent lamp using a filament electrode that can decrease both end areas in which light is not typically able to be emitted such that light can be emitted with a wider range.

In the above-described exemplary embodiments, the pair of connecting pipes 14, 15 can include materials or be configured of materials that provide a getter function. However, it is possible to provide separate or other structures that function as a getter. In addition, the connecting pipes 14, 15 are shown as cylindrical with a circular cross-section. However, this shape can be varies greatly and remain within the spirit and scope of the disclosed subject matter. For example, the pipes 14, 15 can be configured to have a polygonal cross-section, non-symmetrical cross-section, oval cross-section or other cross section. In addition, the shape of the pipes 14, 15 can change along the longitudinal axis of the pipes 14, 15. In particular, the wall thickness and shape can vary at different locations along the pipes 14, 15 to facilitate pressure bonding and the like. The filament coil 13 can be formed in a double helical shape. However, it is contemplated that the shape of the filament coil 13 can be formed in various other shapes and configurations without limitation. In addition, the electrodes 10, 20 and 30 of the exemplary embodiment can be configured for use in a fluorescent lamp. However, these electrodes can also be configured for use in other types of bulbs and the like without departing from the spirit and scope of the presently disclosed subject matter.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A filament electrode comprising:

a pair of connecting pipes configured in a tubular shape, each of the connecting pipes including a first end and an opposite end;

a pair of lead wires located substantially parallel with respect to each other, each of the lead wires having a first end attached to a respective first end of the pair of connecting pipes in a telescoped state via pressure bonding, and each of the lead wires having an opposite end exposed in order to receive a power supply; and a filament coil including two connecting parts, each of the two connecting parts including a connecting end attached to a respective opposite end of the pair of connecting pipes in a telescoped state via pressure bonding such that each respective connecting end of the connecting part is spaced from and does not contact a respective first end of the pair of lead wires.

2. The filament electrode according to claim 1, wherein the pair of connecting pipes is composed of a conductive material having a coefficient of thermal conductivity smaller than a coefficient of thermal conductivity of the pair of lead wires.

3. The filament electrode according to claim 2, wherein the pair of connecting pipes includes a squeezing part located between each first end of the pair of connecting pipes and each respective opposite end of the pair of connecting pipes.

4. The filament electrode according to claim 3, wherein the pair of connecting pipes includes a getter material that functions as a getter.

5. The filament electrode according to claim 4, further comprising:

a bead formed in a substantially circular shape, wherein the bead is located adjacent the opposite exposed end of at least one of the pair of lead wires in an air proof state between the bead and the at least one of the pair of lead wires.

6. The filament electrode according to claim 3, further comprising:

a bead formed in a substantially circular shape, wherein the bead is located adjacent the opposite exposed end of at least one of the pair of lead wires in an air proof state between the bead and the at least one of the pair of lead wires.

7. The filament electrode according to claim 2, wherein the pair of connecting pipes are each formed in a tapered shape so as to shrink from each first end of the pair of connecting pipes towards each respective opposite end of the pair of connecting pipes.

8. The filament electrode according to claim 7, wherein the pair of connecting pipes includes a getter material that functions as a getter.

9. The filament electrode according to claim 8, further comprising:

a bead formed in a substantially circular shape, wherein the bead is located adjacent the opposite exposed end of at least one of the pair of lead wires in an air proof state between the bead and the at least one of the pair of lead wires.

10. The filament electrode according to claim 7, further comprising:

a bead formed in a substantially circular shape, wherein the bead is located adjacent the opposite exposed end of at least one of the pair of lead wires in an air proof state between the bead and the at least one of the pair of lead wires.

11. The filament electrode according to claim 2, wherein the pair of connecting pipes includes a getter material that functions as a getter.

12. The filament electrode according to claim 11, further comprising:

a bead formed in a substantially circular shape, wherein the bead is located adjacent the opposite exposed end of at least one of the pair of lead wires in an air proof state between the bead and the at least one of the pair of lead wires.

13. The filament electrode according to claim 2, further comprising:

a bead formed in a substantially circular shape, wherein the bead is located adjacent the opposite exposed end of at least one of the pair of lead wires in an air proof state between the bead and the at least one of the pair of lead wires.

14. A fluorescent lamp including the filament electrode according to claim 13, comprising:

a tube configured in a tubular shape, an inner surface of the tube including a phosphor layer, and each end of the tube including a respective filament electrode located opposite to each other and fixed between each end of the tube, and including a respective bead including a respective pair of lead wires fixed in the respective bead in an air proof state; and a filler gas located in the tube.

15. The filament electrode according to claim 1, wherein the pair of connecting pipes includes a squeezing part located between each first end of the pair of connecting pipes and each respective opposite end of the pair of connecting pipes.

16. The filament electrode according to claim 15, wherein the pair of connecting pipes includes a getter material that functions as a getter.

17. The filament electrode according to claim 16, further comprising:

a bead formed in a substantially circular shape, wherein the bead is located adjacent the opposite exposed end of at least one of the pair of lead wires in an air proof state between the bead and the at least one of the pair of lead wires.

18. The filament electrode according to claim 15, further comprising:

a bead formed in a substantially circular shape, wherein the bead is located adjacent the opposite exposed end of at least one of the pair of lead wires in an air proof state between the bead and the at least one of the pair of lead wires.

19. A fluorescent lamp including the filament electrode according to claim 18, comprising:

a tube configured in a tubular shape, an inner surface of the tube including a phosphor layer, and each end of the tube including a respective filament electrode located opposite to each other and fixed between each end of the tube, and including a respective bead including a respective pair of lead wires fixed in the respective bead in an air proof state; and a filler gas located in the tube.

20. The filament electrode according to claim 1, wherein the pair of connecting pipes are each formed in a tapered shape so as to shrink from each first end of the pair of connecting pipes towards each respective opposite end of the pair of connecting pipes.

21. The filament electrode according to claim 20, wherein the pair of connecting pipes includes a getter material that functions as a getter.

22. The filament electrode according to claim 21, further comprising:

a bead formed in a substantially circular shape, wherein the bead is located adjacent the opposite exposed end of at least one of the pair of lead wires in an air proof state between the bead and the at least one of the pair of lead wires.

23. The filament electrode according to claim 20, further comprising:

a bead formed in a substantially circular shape, wherein the bead is located adjacent the opposite exposed end of at least one of the pair of lead wires in an air proof state between the bead and the at least one of the pair of lead wires.

24. The filament electrode according to claim 1, wherein the pair of connecting pipes includes a getter material that functions as a getter.

25. The filament electrode according to claim 24, further comprising:

a bead formed in a substantially circular shape, wherein the bead is located adjacent the opposite exposed end of at least one of the pair of lead wires in an air proof state between the bead and the at least one of the pair of lead wires.

26. A fluorescent lamp including the filament electrode according to claim 25, comprising:

a tube configured in a tubular shape, an inner surface of the tube including a phosphor layer, and each end of the tube including a respective filament electrode located opposite to each other and fixed between each end of the tube, and including a respective bead including a respective pair of lead wires fixed in the respective bead in an air proof state; and a filler gas located in the tube.

27. The filament electrode according to claim 1, further comprising:

a bead formed in a substantially circular shape, wherein the bead is located adjacent the opposite exposed end of at least one of the pair of lead wires in an air proof state between the bead and the at least one of the pair of lead wires.

28. A fluorescent lamp including the filament electrode according to claim 27, comprising:

a tube configured in a tubular shape, an inner surface of the tube including a phosphor layer, and each end of the tube including a respective filament electrode located opposite to each other and fixed between each end of the tube, and including a respective bead including a respective pair of lead wires fixed in the respective bead in an air proof state; and a filler gas located in the tube.

29. The fluorescent lamp of claim 28, wherein the tube is a glass tube.

30. The filament electrode according to claim 27, wherein the bead is a glass bead.

* * * * *